US005571403A

United States Patent [19]

Scott et al.

[11] Patent Number: 5,571,403

[45] Date of Patent: Nov. 5, 1996

[54] PROCESS FOR EXTRACTING HYDROCARBONS FROM DIATOMITE

[75] Inventors: Thomas G. Scott; Frederick B. Seufert, Houston; Edward J. Hanzlik, Katy, all of Tex.

[73] Assignee: Texaco Inc., White Plains, N.Y.

[21] Appl. No.: 468,905

[22] Filed: Jun. 6, 1995

[51] Int. Cl.[6] ..... C10G 1/04

[52] U.S. Cl. ..... 208/428; 208/429

[58] Field of Search ..... 208/428, 429

[56] References Cited

U.S. PATENT DOCUMENTS

| | | | |
|---|---|---|---|
| 3,696,133 | 10/1972 | Lloyd et al. | 260/412.8 |
| 3,958,027 | 5/1976 | Alexander et al. | 196/74 |
| 4,167,470 | 9/1979 | Karnofsky | 208/8 LE |
| 4,376,073 | 3/1983 | Farmer | 426/656 |
| 4,461,695 | 7/1984 | Williams | 208/11 LE |
| 4,571,294 | 2/1986 | Friedman et al. | 208/11 LE |
| 4,683,029 | 7/1987 | Oyler et al. | 196/14.52 |
| 4,859,371 | 8/1989 | Diosady et al. | 260/412.3 |

*Primary Examiner*—Helane Myers
*Attorney, Agent, or Firm*—Kenneth R. Priem; James L. Bailey; Cynthia L. Hunter

[57] ABSTRACT

An improved process for extracting hydrocarbons from a diatomite ore which comprises the combination of the steps of:

a) Reducing the particle size of the ore to form a processed ore;

b) Grinding the processed ore in an enclosed pin mixer to form pelletized ore;

c) Feeding the pellets into each section of a ROTOCEL® extractor unit containing 5–8 sections or baskets to form columns of pelletized ore;

d) Distributing a solvent from the top of each column of the ROTOCEL® extractor and allowing the solvent to permeate the pelletized ore column to form a hydrocarbon-rich solvent stream while leaving behind spent ore mixture;

e) Separating extracting solvent from the hydrocarbon solvent stream to form a hydrocarbon product stream and an extracting solvent stream;

f) Removing the spent ore mixture from the extracting zone;

g) Recycling the extracting solvent; and h) Recovering the hydrocarbon product.

22 Claims, 6 Drawing Sheets

PROCESS FOR EXTRACTING HYDROCARBONS FROM DIATOMITE

FIELD OF THE INVENTION

This invention relates to extraction of hydrocarbons from diatomite. More particularly, it relates to a method of extracting hydrocarbons from diatomite which incorporates a number of improvements and recovers as much as 90% of the extractable hydrocarbons as crude oil.

A combination of improvements contribute to the improved yield. Agglomeration is performed by equipment known in the industry as Pin Mixers, Turbulators®, etc. This agglomeration technique increases production rates, reduces undesirable environmental emissions and produces stronger pellets. A six or seven stage countercurrent extraction process employing toluene/naphtha as solvents also contributes to the improved process. A screw conveyer heated by steam desolventizes the spent ore and the exiting ore has less than 0.1% by weight solvent. Recovered solvents from the oil and the desolventizer step are recycled to the extraction process.

BACKGROUND OF THE INVENTION

Many earth formations contain deposits having substantial amounts of hydrocarbons. Included among these are oil bearing diatomaceous earths. Diatomite is a lightweight marine sedimentary rock that is composed of the microscopic silicon shells of single cell plants known as diatoms. The diatom skeletons are cemented by oil and water into soft aggregates. The material contains hydrated silica, is opaline in form, and is highly porous. It is also known as diatomaceous earth, Fullers earth or Kieselguhr.

Such deposits, in addition to the oil saturated diatomaceous particles, also contain some fine clay, silt and water. A typical diatomite ore contains about 12 percent oil and 34 percent water occupying the space inside and between the hollow diatom skeletons. It is a friable solid, slightly unctuous, but not damp.

Conventional technology would suggest that in situ techniques could be used to produce the oil in the diatomaceous reservoirs. Miscible flood methods are commonly used to extract heavy oil from impermeable reservoirs. During a miscible flood, a solvent is injected into the oil bearing formation through injection wells. The viscosity of the oil changes when mixed with solvent, allowing water injected afterwards to displace the oil/solvent mixture and flush it toward the producing wells. However, the low permeability of the diatomite reservoir restricts the flow of fluids and it is not possible to use in situ solvent techniques.

In order for the hydrocarbons in diatomite to be recovered by means of solvent extraction it is generally necessary to increase solvent permeability in order to provide sufficient contact between the solvent and hydrocarbons. One way to increase permeability is to crush the ore. The crushed ore should have open space that solvent can enter and contact the soluble crude oil. Attempts to flow solvents through a stationary bed of crushed diatomite ore causes the ore to compress and prevents subsequent solvent flow at a rate of commercial interest. Attempts to mix crushed diatomite ore in excess solvent are successful in dissolving the crude oil into the solvent, but the diatomite fines are difficult to settle out by gravity. Due to these characteristics, a variety of processes have developed which use settlement techniques and a number of stages to bring the extracting solvent into contact with the diatomite ore and successively separate off the resulting oil-solvent mixtures.

U.S. Pat. No. 4,167,470 to Karnofsy, describes a process to recover petroleum crude oil from oil laden diatomite by a continuous stage wise countercurrent extraction-decantation process. Ore is extracted by countercurrent decantation with a hydrocarbon solvent. The solvent is recovered from the extract by multiple effect evaporation followed by stripping. The spent diatomite is contacted with water and the solvent is recovered from the resulting aqueous slurry of spent diatomite by steam stripping at super atmospheric pressure. In the Karnofsy patent a heated slurry of diatomite and solvent is discharged into a settling zone where the particles of diatomite settle to the bottom as a thixotropic mud for removal through an underflow mechanism. Overflow from this first stage is then passed to a clarifier where fine solid material settles to the bottom. A series of extraction stages comprising mixers and thickeners is employed to further extract the oil and separate out any solid material, including fines.

In U.S. Pat. No. 4,461,695, and U.S. Pat. No. 4,571,294, incorporated herein by reference in their entirety, there is disclosed a method of extracting hydrocarbons from a diatomite ore. The particle size of the ore is first reduced to form a processed ore. The processed ore is then mixed with a substantially irregular granular material to form an unstratified mixture having increased permeability to an extracting solvent. The unstratified ore mixture is then permeated with an extracting solvent to obtain a hydrocarbon-solvent stream from which hydrocarbons are subsequently separated. This work did not provide sufficient data to predict what kind of recovery could be expected in a commercial operation.

Problems often associated with production from diatomite reservoirs include low permeability, high viscosity of the oil, poor sweep efficiency in water and steam floods, low reservoir pressure, and high residual oil saturation.

Currently, one of the most successful fields for recovering oil from diatomite is the Belridge diatomite formations. However, less than 20% of the oil in place is recovered in that field using conventional steam technology. Even in highly permeated sand, steam only recovers approximately 50%.

Methods used in the past to attempt to extract the hydrocarbons from mined diatomite ore included solvent extraction and retorting, using a Lurgi Retort. With the solvent method there are problems getting the solids to drop out of solution. In some methods an emulsion of oil, solvent and water may form. The retorting method results in hydrogen deficient products which are unstable and either have to be saturated right away or moved quickly to a refinery.

Other undesirable aspects of available technology include, for example, the need to grind the ore extremely fine before it can be fed to an open pan type pelletizer. In addition, the pelletizing step requires the addition of binders which may complicate later steps. There are also environmental pollution problems with pelletization using open pan type pelletizing equipment in terms of volatile organic and particulate emissions.

There is a need in the art for an improved process for recovering hydrocarbons from diatomite which would recover a higher percentage of the hydrocarbon with less impact on the environment.

SUMMARY OF THE INVENTION

In accordance with the foregoing the instant invention is directed to an improved method for hydrocarbon extraction from diatomaceous earth which comprises in combination:

reducing the particle size of the ore to form a processed ore;

using the processed ore as feed to an enclosed pin mixer/Agglomulator® type pelletizer to form pellets having increased permeability;

feeding the pellets into each section of a ROTOCEL® extractor unit containing 5–8 cells;

flooding the cells containing ore with successive washes of solvent in consecutive stages, counter to the rotation of the ROTOCEL®;

using heavy solvent in the first cells, or early stages, to enhance hydrocarbon recoveries and a lighter solvent to displace the heavy solvent miscella in the later stages to reduce desolventizer heat requirements later in the process, remove any traces of benzene or similar naturally occurring carcinogen, and prevent deposition of soluble asphaltenes on the desolventizing equipment;

separating extracting solvent from the hydrocarbon rich solvent stream to form hydrocarbon product stream and an extracting solvent stream; and removing the spent ore mixture from the extracting zone.

The process of the instant invention, used to recover oil from the diatomite overcomes producibility problems associated with conventional in situ processes, including low permeability, low reservoir pressure, and poor sweep efficiency associated with water, steam and CO2 injection recovery methods. The process of the instant invention overcomes processing problems associated with existing ex-situ processes including poor permeability of the ore to solvent; difficulties associated with settling of fines in a solvent, water, crude oil and diatom mixture; volatile organics and particulate emissions from open pan pelletizers; residual carcinogens on the spent ore; asphaltene precipitation on the desolventizing equipment; and, undesirable vaporization of water during the desolventizing phase of processing.

There follows a detailed description of one or more embodiments of the present improved process in conjunction with the foregoing drawings. This description is to be taken by way of illustration rather than limitation.

DETAILED DESCRIPTION OF THE PREFERRED EMBODIMENT

Figure 1:
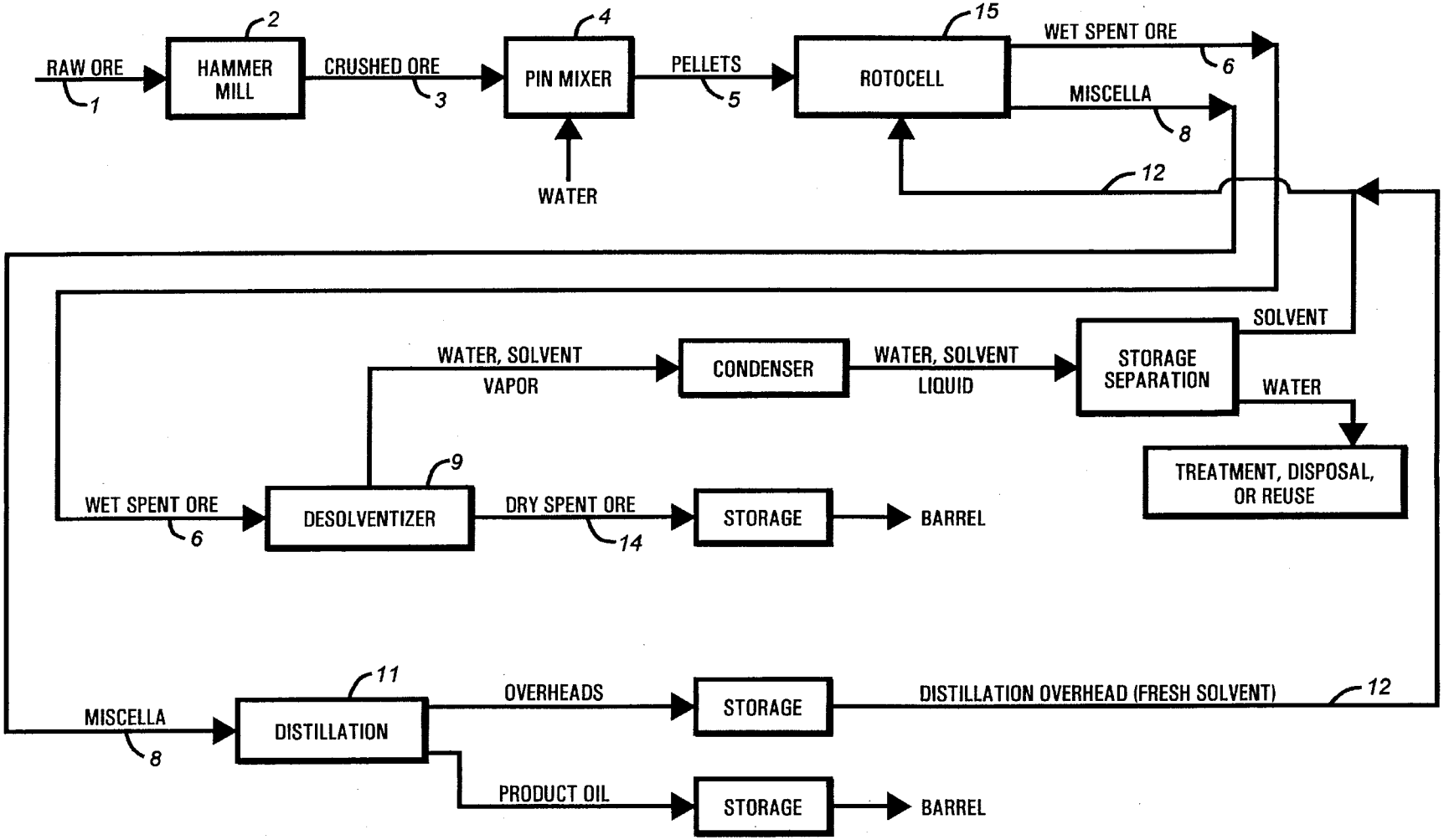
FIG. 1 is a flow diagram representing the diatomite extraction process of this invention.

Referring generally to FIG. 1 there is shown a flow chart of the preferred embodiment of the present invention.

Ore was mined in a front end loader and ground to less than 6 inch pieces with a road type tiller. Ore was further ground at a commercial ore preparation facility to less than 2 inch pieces using a Hazmag impact crusher and a Simpson mix mueller. The resulting ore is processed in the grinder, 2. The ore is pulverized or crushed by means of conventional construction as would be known to one skilled in the art, such as, for example, a small hammermill. The crushed ore should be of a size in the range of 10 to 200 mesh (0.08–0.02 inches).

The final grinding step also increases the amount of fines in the ore. Large quantities of fines are desirable for the pelletization step. After the final grinding the crushed ore is passed to the pelletizing zone, 4, where it enters a pin mixer.

In the art it has been common for the crushed ore to be pelletized in an open rotating pan type of pelletizing equipment. Although the open pan pelletizing equipment would require less energy, it could require the addition of a binder. A binder is not desirable due to additional cost and reduction of efficiency of extraction for pellets containing a binder. Pellets produced from an open pan type pelletizer would require a drying step after formation of the pellets. Pellets produced using the open pan type equipment have a surface coating of water making them sticky or difficult to handle and transport. This drying step would require additional energy, capital costs of drying equipment, air emissions and loss of valuable hydrocarbons.

Figure 2:
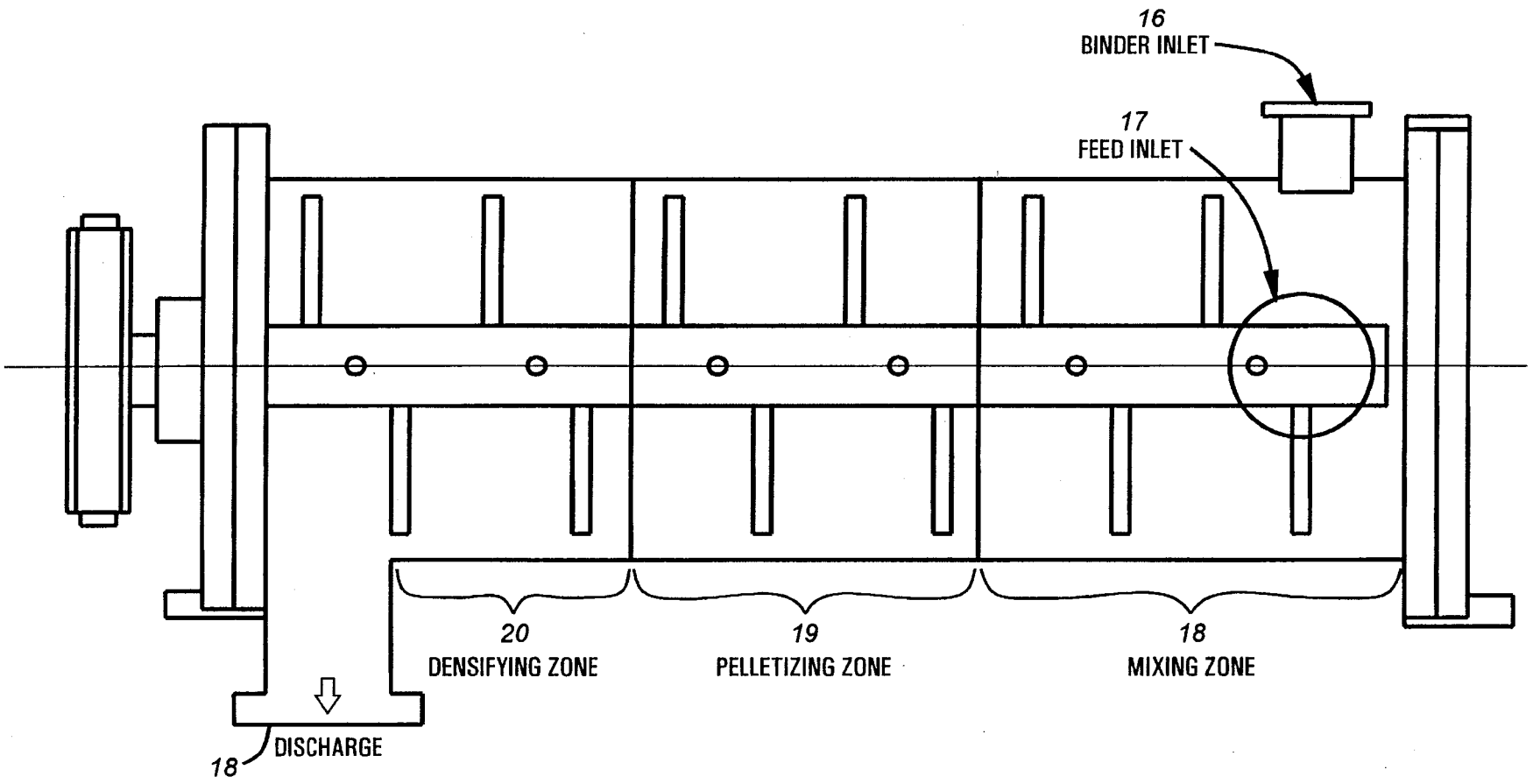
FIG. 2 is a diagram of a pin mixer-pelletizer.

The preferred method for forming pellets in the instant invention is a pin mixer. The pin mixer is a horizontal, stationary shell, solids-liquid mixer with a rotating agitator or rotor. The rotor is a shaft extending axially through the length of the shell and through seals at each end of the shell. A varying number of cylindrical rods, or pins are positioned along the rotating shaft. The material to be agglomerated into pellets is fed into the pin mixer by means of a screw feeder. The action within the pin mixer occurs in three zones, the mixing zone, 18, the pelletizing zone, 19, and the densifying zone,20, (FIG. 2). In the mixing zone, 18, water is added if required. The water is blended with the crushed diatomite to provide a uniform coating. In the pelletizing zone, 19, each coated particle comes into contact with other coated particles, which begin joining together into nuclei through capillary force. In the densifying zone, 20, air is eliminated and the volume of material reduced, as the nuclei continue to join together. Finally, completely formed diatomite pellets, about one-eighth inch in size, are discharged from the pin mixer and passed to the extractor.

The use of the pin mixer has a number of advantages. One very important advantage from an environmental standpoint is that the pin mixer pelletizing process can be totally enclosed from the mining step through grinding and loading to the extraction equipment, 15, thus reducing air quality problems. Other advantages are that the pellets produced are denser and stronger. It is not necessary to add a binder to the crushed ore and less water is required. Use of a binder in pelletizing has been shown to reduce permeability of the pellets resulting in a lower than desirable extraction efficiency. In addition, the pin mixer affords a much higher rate of production. For example, a small diameter unit had production rates slightly less than one ton/hour.

The pellets formed in the pin mixer are then fed into the extraction zone, 15 (FIG. 1). Extracting solvent is introduced via a solvent line, 12, into the extraction zone. The pellets are fed into the first cell of the ROTOCEL®, FIG. 3. The ROTOCEL® equipment is a rotating bucket extractor capable of countercurrent solvent extraction as described in U.S. Pat. No. 2,840,459, incorporated by reference herein in its entirety. It is manufactured by Dravo corporation, and is generally used for agricultural products, such as oilseed.

Figure 3:
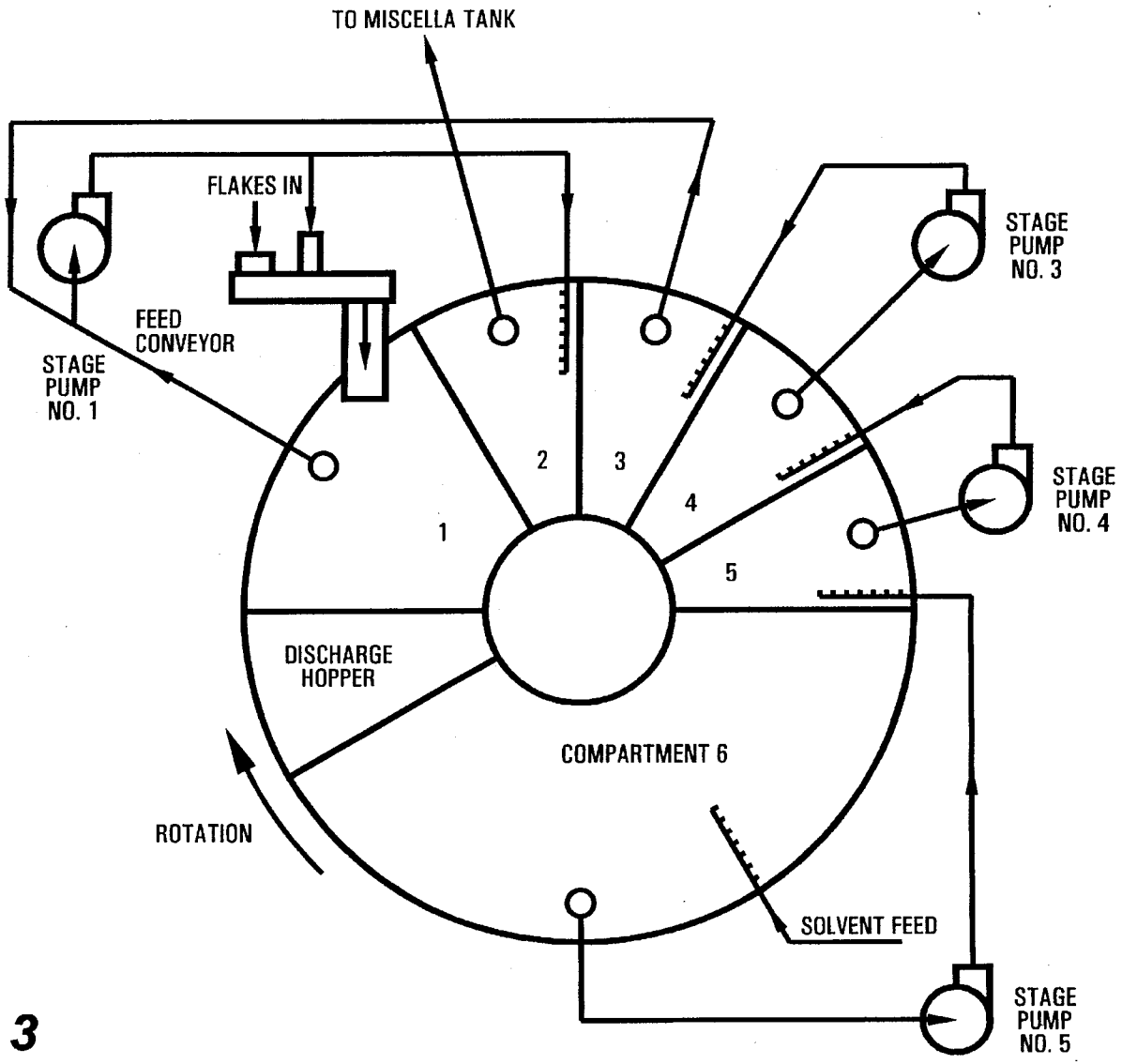
FIG. 3 is a schematic diagram of the ROTOCEL® extractor.

FIG. 3 is an enlargement of the ROTOCEL® extractor and shows the general construction and operation of the ROTOCEL®. The rotor, which is divided into sector-shaped cells, turns at a slow, controllable speed inside a vapor-tight tank. Material is continuously fed into the cells, as a slurry in miscella—that is, solvent already containing some extracted liquid—and is supported on hinged doors which are, in turn, supported by rollers on a track. As they move around the circular path, the cells are flooded by successive washes of miscella gradually approaching fresh solvent. After a spray of fresh solvent, the solids are permitted to drain by gravity before they are discharged. Liquids draining from the cells collect under the rotor in compartments from which they are withdrawn by stage pumps. At the proper time the door falls from the supporting track, discharging the drained solids. Miscella is withdrawn and sent for the separation of product oil from solvent.

Material is fed into the ROTOCEL® through a horizontal liquid tight screw conveyor. This conveyor has two functions: (1) to seal against the loss of solvent vapor and (2) to slurry the feed with the miscella. The slurry spreads across the cells of the rotor to provide a uniform fill.

The ROTOCEL® provides 6 or 7 stage counter current extraction. Solids are loaded using a weigh hopper.

Conditions for extractions include a temperature in the range of ambient to 300° F. The preferred temperature is between 100°–200° F., particularly 160° F.–180° F. The solvent is heated at the solvent inlet and before the last stage wash for heat transfer to incoming room temperature ore. The flow rate of the solvent is slightly less than 1 gallon per minute.

Figure 4:
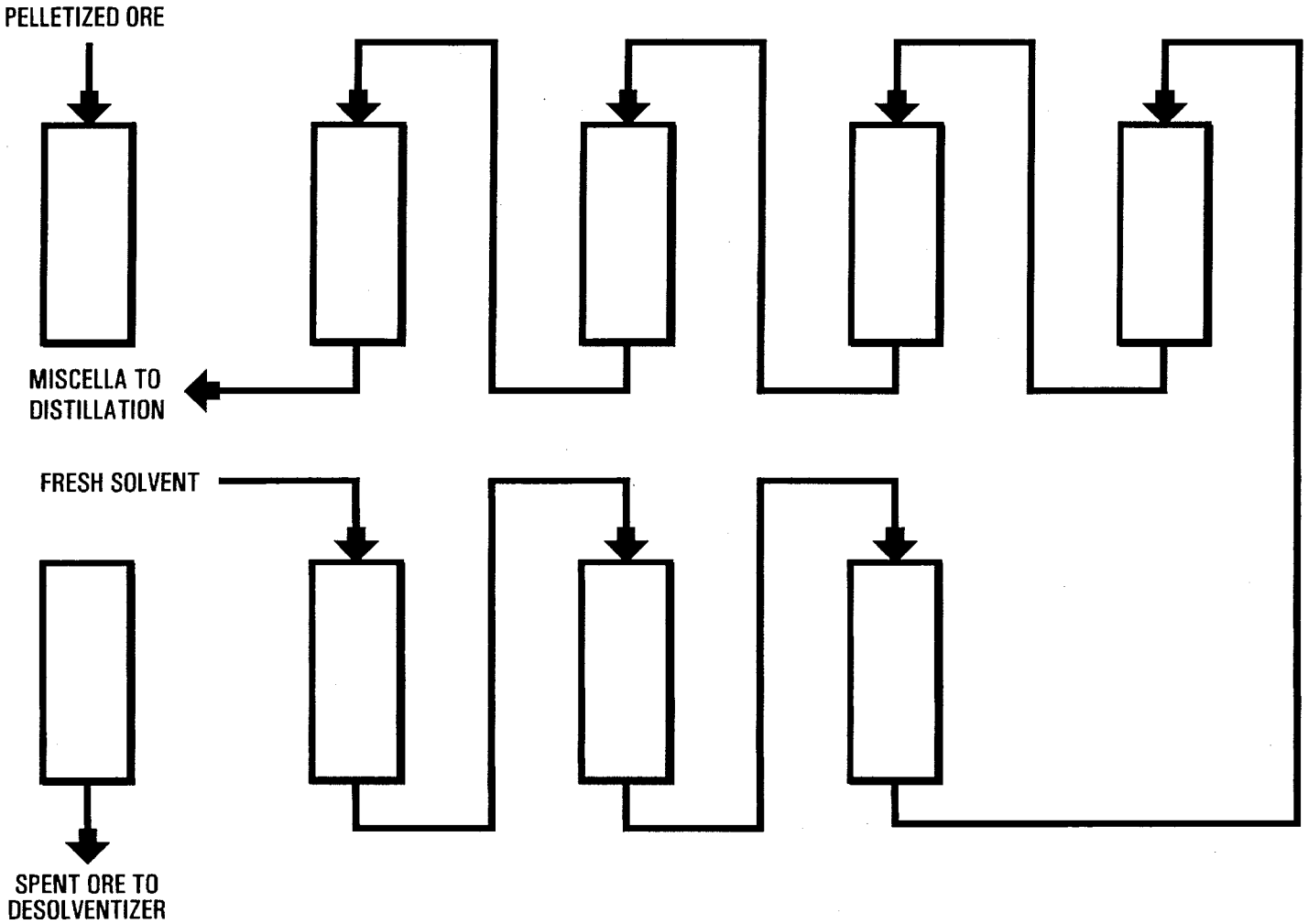
FIG. 4 is a flow chart of the solvent system of the instant invention.

FIG. 4 is a flow diagram showing the extraction cycle. After pelletizing, the ore is extracted in the multi-basket rotating extractor which is enclosed within a vapor containment vessel. The extraction cycle for each basket within the ROTOCEL® extractor consists essentially of:

1) loading pelletized ore into the basket;

2) 5–8 stages of countercurrent solvent extraction;

3) a drainage stage; and 4) dumping the ore from the basket for removal from the extractor enclosure and transport to a desolventizer.

The process recovers approximately 90% of extractable hydrocarbon from the prepared ore.

The solvent used in the extraction is a straight run naphtha indigenous to the extracted crude. An initial charge of solvent not indigenous to the crude will be required for start up. This nonindigenous start up solvent will be diluted to infinity as naphtha from the extracted crude is added to the fresh solvent storage. Examples of preferred start up solvents which are not indigenous are toluene and naphtha from similar local crude oils.

An important feature of this process is that the extraction solvent is a component of the product oil. That is, one or more solvent fractions e.g. naphtha, of the product oil are used as solvents. In the preferred embodiment additional solvent is continually recovered from the diatomite by fractionation in order to recycle it to the process (FIG. 1, at 12). This solvent typically has a boiling point range of 170° F.– 400° F. Operating temperature of the extractor typically ranges from ambient to 200° F. The boiling point range of the preferred solvent includes benzene and toluene.

Those skilled in the art will recognize that in order to optimize oil extraction, the retention time in each extractor cell could be increased, more washes could be added or a higher solvent to oil ratio used, the extraction temperature could be increased, or multiple solvents can be used.

The extracted and drained diatomite is removed, FIG. 1, at 6, and sent to a desolventizing section, 9, where it is heated to vaporize the solvent. A sweep gas such as steam may also be used to improve the desolventizing process by lowering the partial pressures of the solvent components. The desolventizing process is capable of producing spent ore material, 14, having very low residual solvent volumes (less than 0.1 weight percent on a non-optimized system).

In recent years environmental regulations have become much more rigid and there are very strict regulatory limits on the amounts of aromatics that can remain on spent ore before the material is classified as hazardous. Benzene and toluene have desirable solvent properties which improve the effectiveness of oil extraction from the diatomaceous earth, however the use of multicomponent solvents containing these two could result in a spent diatomite material containing trace amounts of benzene and toluene. Measurable trace amounts of benzene and toluene could result in the spent diatomite ore being classified as a hazardous material. Benzene and toluene have been identified as carcinogens or potential carcinogens.

Figure 5:
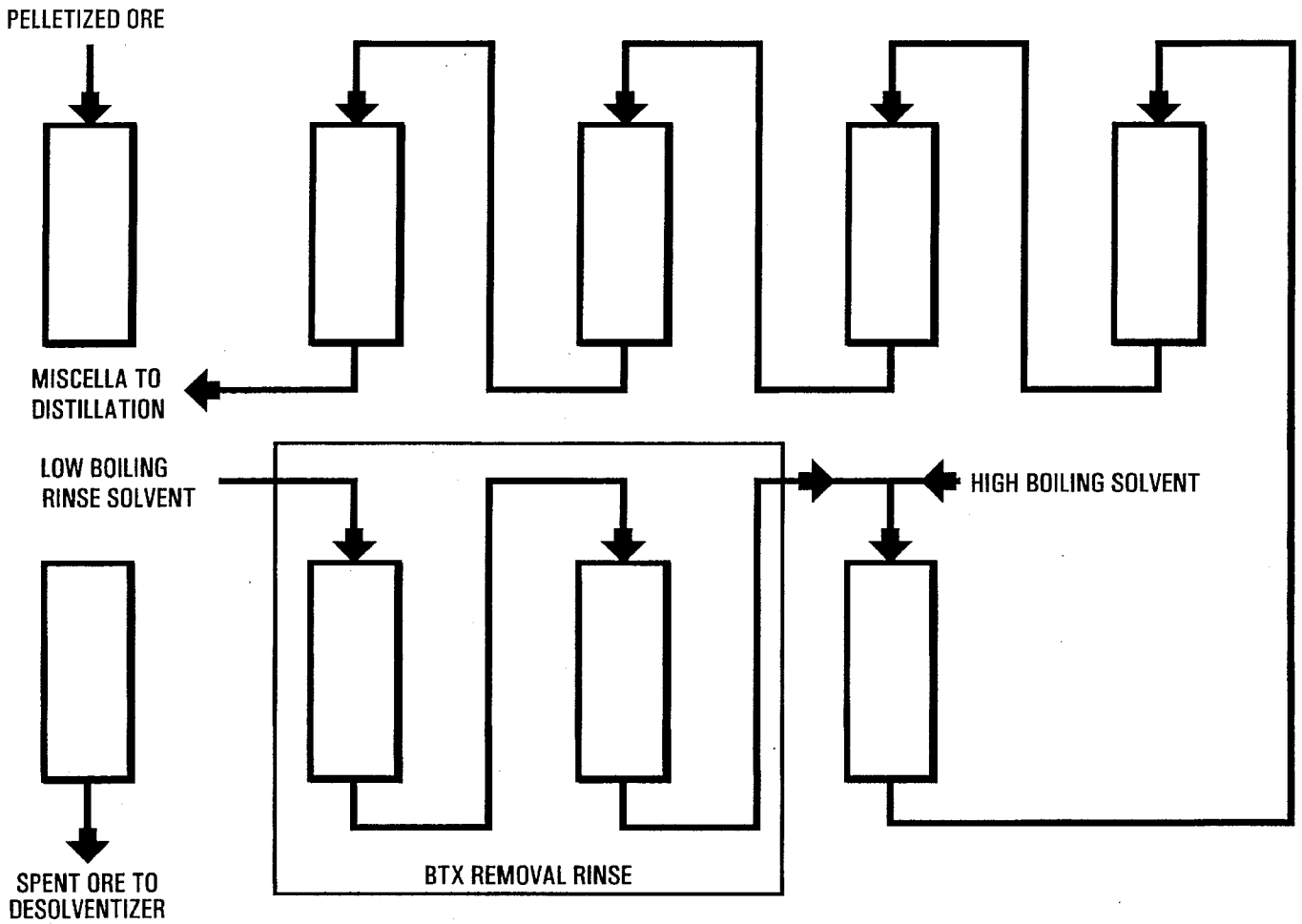
FIG. 5 is a flow chart of an alternative solvent system which reduces residual aromatics on spent ore.

In view of the need for minimal aromatics on the spent ore, another embodiment of the extraction step of this invention provides a separate rinse step following the primary countercurrent extraction using the preferred 150°–250° F. boiling point range solvent. This is represented in FIG. 5. The primary solvent would be allowed to drain and the extracted ore would then undergo an additional rinse (1–3 stages, countercurrent) using a lower boiling fraction of the native naphtha. This rinse naphtha would have a maximum boiling point less than 176° F. Thus, this rinse naphtha would contain no aromatic hydrocarbons (lowest boiling aromatic hydrocarbon is benzene, with a boiling point of 176.2° F.). The rinse miscella could either be added to the extraction solvent and continue through the entire countercurrent extraction process or be recovered and recycled through its own distillation unit to remove higher boiling hydrocarbons rinsed from the ore. Following the rinse, the extracted and rinsed ore would be allowed to drain and then sent to the desolventizing section of the plant. The use of a lower boiling final rinse solvent would minimize any benzene, toluene or xylene carry over in the spent ore and would have the additional benefit of improving the desolventizing operation through lowering the severity of treatment needed to achieve a given residual solvent saturation. The lower boiling rinse naphtha can be produced by adding an additional "takeoff" point to the miscella distillation unit and/or by recycling the rinse naphtha through its own distillation unit.

Figure 6:
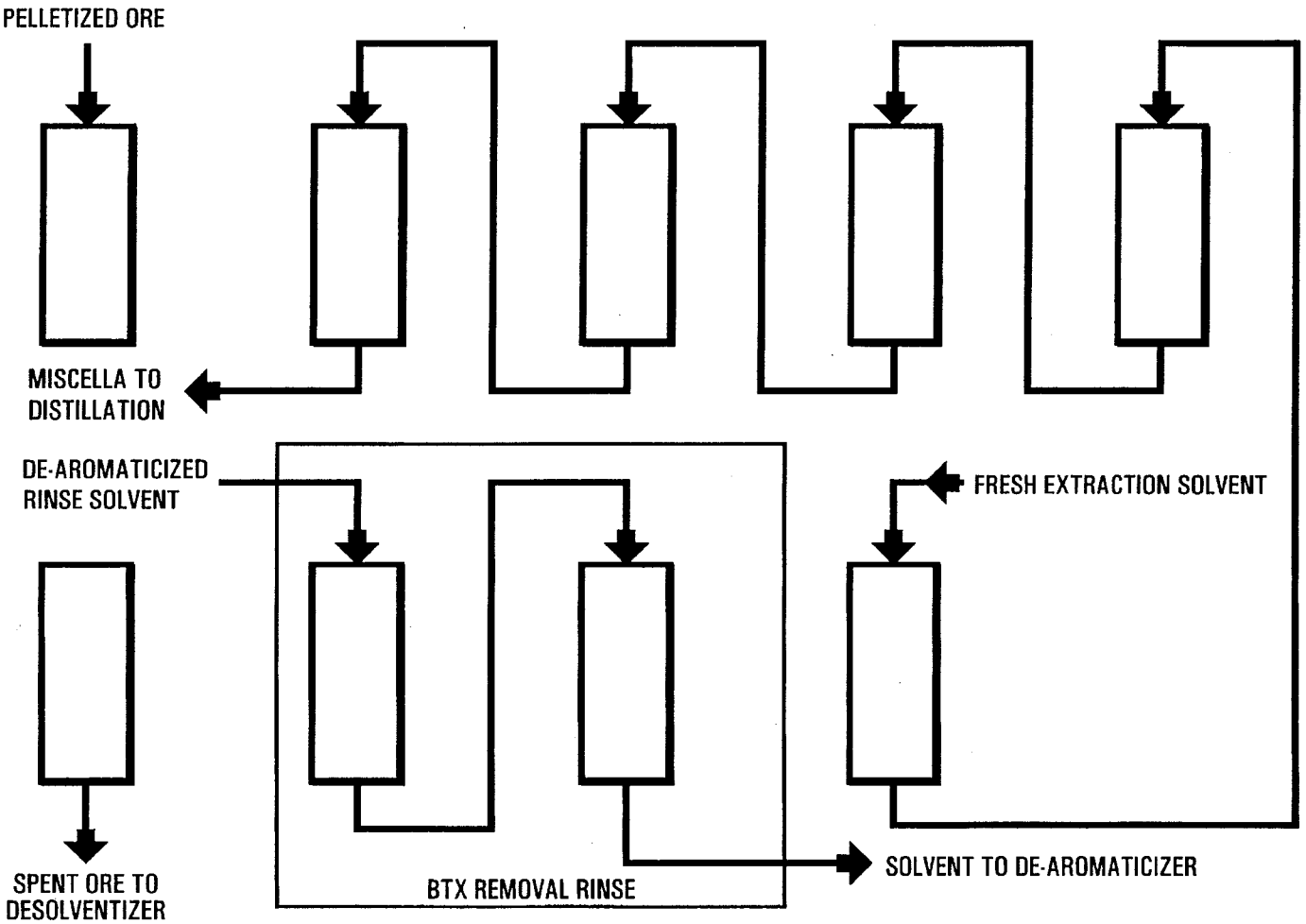
FIG. 6 is a flow chart of a variation of the solvent system shown in FIG. 5.

In a variation of the extraction process shown in FIG. 5, a final rinse solvent comprising a dearomatized stream of naphtha that has an end point higher than 176° F. is used. This is shown in FIG. 6. Prior to being used, the rinse naphtha would have the aromatic components removed by one of the standard refining processes used to remove aromatic compounds. Such processes include solvent refining and adsorption techniques. The used rinse naphtha would then be recycled through the dearomatization unit for repeated use. Make-up solvent naphtha can be added from the miscella distillation unit upstream of the dearomatization unit as needed and treated with the recycled rinse naphtha.

In another embodiment twin solvents are used during extraction. A light solvent issues in the last stages to wash trace components of aromatics out of the spent diatomite ore, and a heavier solvent is used in the early stages to enhance solvent extraction of the heavy hydrocarbons.

The temperature range useful in the instant process is ambient to 300° F. Oil recovery remained fairly constant for all tested operating temperatures. The preferred temperature was 100°–200° F., however ambient temperatures should work.

From the extraction unit, the spent ore is fed to the desolventizing section of the unit. Recovery of remaining solvent in the spent ore was accomplished using a Denver holofite double screw conveyor heated by 180° F. saturated steam. Rotary locks were employed at both ends of the desolventizing equipment to prevent escape of solvent vapors.

Steam can also be used in desolventizing, however injected steam could cause the ore to have too high a moisture content for solids handling equipment downstream.

The solvent vapors exiting the desolventizing unit enter a vent condenser which has a water cooled shell and tube unit with condensation on the shell side. Vapors from the desolventizer and ROTOCEL® are drawn through the condenser by a centrifugal blower. Slight vacuum conditions of less than 1 inch of water are maintained in the ROTOCEL® and desolventizer.

Separation of solvent and oil was performed using a conventional packed distillation column during the pilot demonstration testing. The solvent is recycled back to the extractor. Recovered solvents, 12, from the oil and the desolventizer step are recycled to the extraction process.

The miscella from the ROTOCEL® extractor is fed into the fractionation unit, as indicated in FIG. 1, at 8 and 11. Separation of the solvent and extracted oil mixture is performed by an atmospheric pressure stainless steel distillation column which measured about 18.6 feet by 13.75 inches in diameter. The solvent is recovered as overheads from the column and recycled, 12, to the extraction process and the crude oil is recovered. See Texaco Inc., DE-PS22-94BC14973, Vol. II, Technical Proposal, June, 1994, incorporated herein by reference in its entirety.

After desolventizing there are a number of potential uses for the spent ore which could offset costs of stockpiling and later refilling/recontouring the mining pit. The spent ore might be used as a raw material for the glass or aggregate industries. For example, the spent ore could be used in glass manufacture, roof/road aggregate material, a general purpose building material, or as a glass envelope to encase other hazardous materials containing soluble inorganic heavy metals, salts, etc.

Expected residual hydrocarbon content of the spent ore would enhance the vitrification process by adding a portion of the necessary fuel required for fusion.

Another application of the process described herein is for cleaning a water stream contaminated with hydrocarbons. Water indigenous to the solids or water introduced into the process appeared to exit the process only with the solids. Inlet solvent with as high as 17% water volume was introduced into the process. No water was observed leaving with the miscella after extraction. A mixture or emulsion/sludge of hydrocarbons and water could be introduced into the process equipment for separation.

The following examples are given only for the purposes of illustration and are not intended to limit the invention in any way:

EXAMPLE

In a 3-ton a day pilot unit there was a test run involving the processing of about 27 tons of ore and the 15 following operation data was recorded:

| | | | |
|---|---|---|---|
| Total Ore Processed | Toluene Extraction | | 10.6 tons |
| | Naphtha Extraction | | 16.5 tons |
| | | | 27.1 tons |
| Total Operating Time | Toluene Extraction | | 21 runs |
| | Naphtha Extraction | | 7 runs |
| | 331 hours in operation | | |
| | 267 hours feeding pellets | | |
| Total Solvent Used | 12101 gallons (assuming no recycle) | | |
| | | measured | real |
| Total Oil Production | Toluene Extraction | 24.5 bbl | 24.3 bbl |
| | Naphtha Extraction | 16.8 bbl | 13.9 bbl |

The resulting diatomite crude was analyzed by the Star Port Arthur Research Laboratory and the properties were compared to a similar oil, Kern River Crude, produced by conventional oil productions. The diatomite crude and Kern River Crude compared as follows:

| Crude | Diatomite Crude | Kern River |
|---|---|---|
| Total Sulfur (wt. %) | 0.95 | 1.2 |
| Total Nitrogen (WPPM) | 6454 | 7289 |
| API Gravity (@ 60 deg. F.) | 13.7 | 13.1 |
| Pour Point (deg. F.) | –30 | 20 |
| Salt content (gms/bbl.) | 4.0 | 2.4 |
| Microcarbon residue (wt. | 7.36 | 7.67 |
| Vanadium (WPPM) | 36 | 31 |
| Nickel (WPPM) | 49 | 66 |
| Iron (WPPM) | 626 | 38 |

We claim:

1. An improved process for extracting hydrocarbons from a diatomite ore which comprises in combination the steps of:

a) reducing the particle size of the ore to form a processed ore;

b) grinding the processed ore in an enclosed pin mixer without a binder and without drying step to form pelletized ore, wherein the addition of water is optional;

c) feeding the pelletized ore into each section or cell of a rotating extractor unit capable of countercurrent extraction and containing 5–8 sections to form a column of pelletized ore in each section;

d) distributing a solvent from the top of each section of the rotating extractor consecutively, counterclockwise to the rotation of the extractor, and allowing the solvent to permeate the pelletized ore column in each section to form a hydrocarbon-rich solvent stream while leaving behind extracted spent ore mixture wherein the extraction cycle for each section within the extraction comprises:

a) loading pelletized ore into the basket;

b) solvent extracting in 5–8 stages counter-currently;

c) draining the extracted ore;

d) dumping the spent ore from the basket for removal from the extractor enclosure; and e) transporting to a desolventizer, wherein the solvent is initially nonindigenous to the extracted hydrocarbon and is subsequently diluted with extracted hydrocarbon and becomes indigenous to the extracted hydrocarbon as the cycle continues;

e) separating the hydrocarbon solvent stream to form a hydrocarbon product stream and an extracting solvent stream;

f) removing the spent ore mixture from the extracting zone;

g) recycling the extracting solvent; and h) recovering the hydrocarbon product.

2. The process of claim 1 wherein the processed ore is fed into the pin mixer with no addition of water.

3. The process of claim 1 wherein the processed ore is fed into the pin mixer and water is added..

4. The process of claim 1 which comprises using as solvents selected from the group consisting of benzene, toluene, xylene, and naphtha.

5. The process of claim 4 which comprises using solvents selected from the group consisting of naphtha and toluene.

6. The process of claim 5 wherein the solvent is a fresh naphtha which is diluted with naphtha mixed with indigenous crude.

7. The process of claim 1 wherein prior to distribution of extracting solvent, pelletized ore is loaded into the extractor using a weigh hopper.

8. The process of claim 1 wherein the extraction in the rotating extractor takes place countercurrently in 5–8 stages.

9. The process of claim 8 which further comprises providing a separate rinse step following the countercurrent extraction using a solvent having a boiling point range of 150°–250° F., and draining, which comprises rinsing the extracted ore with 1–3 countercurrent stages of a lower boiling point solvent having a maximum boiling point less than 176° F.

10. The process of claim 9 wherein the lower boiling point solvent is naphtha.

11. The process of claim 10 further comprising the use of naphtha having an end point lower than 176° F., wherein the aromatic component has been removed by a process selected from standard refining processes for removing aromatics.

12. The process of claim 11 further comprising using a gas to improve the desolventizing process by lowering the partial pressure of the solvent components.

13. The process of claim 12 wherein the gas is steam.

14. The process of claim 9 which reduces the amount of aromatics on spent ore and reduces the costs of desolventizing.

15. The process of claim 1 wherein the extraction takes place at a temperature in the range of ambient to 300° F.

16. The process of claim 15 wherein the extraction takes place at a temperature of 80° to 250° F.

17. The process of claim 4 wherein the solvent is heated at the inlet before last stage wash for heat transfer to the incoming room temperature.

18. The process of claim 4 wherein the solvent flow rate is slightly less than 1 gallon per minute.

19. The process of claim 4 wherein the extraction time is one to five hours.

20. The process of claim 4 which comprises removing the extracted and drained ore to the desolventizing section, and heating said diatomite to remove solvent.

21. The process of claim 20 wherein the spent ore is used in a material selected from the group consisting of:

glass manufacture, roof aggregate material, road aggregate material, general purpose building material, and a material to encase hazardous materials.

22. The process of claim 1 which provides reduced emission of volatile organic compounds and particulates.

* * * * *